US007082283B2

(12) United States Patent
Fujita et al.

(10) Patent No.: US 7,082,283 B2
(45) Date of Patent: Jul. 25, 2006

(54) FIXING UNIT AND IMAGE FORMING APPARATUS

(75) Inventors: Shinsuke Fujita, Hachioji (JP); Kyoichi Mizuno, Tama (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 142 days.

(21) Appl. No.: 10/797,687

(22) Filed: Mar. 9, 2004

(65) Prior Publication Data

US 2004/0240912 A1 Dec. 2, 2004

(30) Foreign Application Priority Data

May 29, 2003 (JP) ..... 2003-152271

(51) Int. Cl.
*G03G 15/20* (2006.01)
*H05B 3/00* (2006.01)

(52) U.S. Cl. ..... 399/328; 399/330; 399/69; 219/216

(58) Field of Classification Search ..... None
See application file for complete search history.

(56) References Cited

U.S. PATENT DOCUMENTS 5,682,580 A * 10/1997 Iwama et al. ..... 399/130
5,819,149 A * 10/1998 Watanabe et al. ..... 399/330
5,920,757 A * 7/1999 Izawa et al. ..... 399/329
6,040,558 A * 3/2000 Yamazaki ..... 219/216
6,701,102 B1 * 3/2004 Hasegawa et al. ..... 399/69
6,763,205 B1 * 7/2004 Izawa et al. ..... 399/69
2002/0118977 A1 * 8/2002 Hasegawa et al. ..... 399/69
2004/0240912 A1 * 12/2004 Fujita et al. ..... 399/328

FOREIGN PATENT DOCUMENTS

JP 2001-005333 A 1/2001
JP 2002-304084 A 10/2002

* cited by examiner

*Primary Examiner*—Diego Gutierrez
*Assistant Examiner*—Tiffany A. Fetzner
(74) *Attorney, Agent, or Firm*—Frishauf, Holtz, Goodman & Chick, P.C.

(57) ABSTRACT

A fixing device, comprising a heating roller being rotatable and having a rotating circumferential surface to come in contact with a recording medium holding non-fixed developing agent images so as to heat and melt the non-fixed developing agent images and a temperature detecting unit having a temperature detecting element to detect temperature of the rotating circumferential surface and a support member to support the detecting element, wherein the support member is arranged to come in contact with the rotating circumferential surface at a first contact position on the rotating circumferential surface, the temperature detecting element is arranged to come in contact with the rotating circumferential surface at a second contact position which is located upstream of the first contact position in the rotating direction. This structure provides a high quality toner images by controlling fixing temperature based on a precise temperature detection of the heating roller.

9 Claims, 4 Drawing Sheets

FIG. 4 ( a )
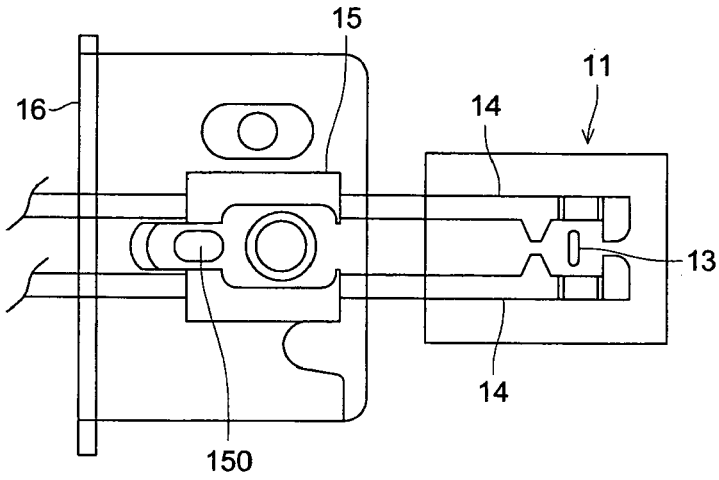
FIG. 4 ( b )
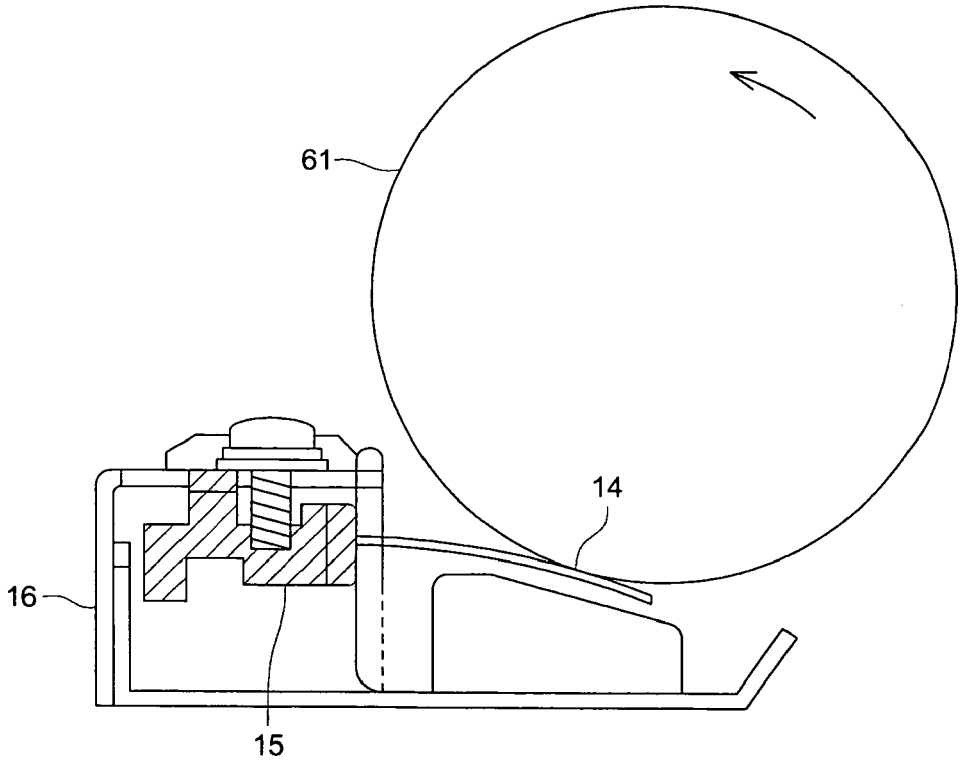

FIXING UNIT AND IMAGE FORMING APPARATUS

BACKGROUND OF THE INVENTION

This invention relates to durable fixing-unit arranged to obtain high quality toner images by detecting surface temperature of a heating member through a contact-type temperature detecting sensor or image forming apparatus incorporating this fixing-unit.

In the prior art, it is generally known and used in an image forming apparatus that after transcribing toner images on a photosensitive material onto a recording medium, the toner images are fixed on the recording medium by heating and being melted with the fixing-unit employing a heating roller and a compression roller. In general, fixing temperature is controlled by a contact-type or non-contact type temperature sensor, which detects temperature of the heating roller, and set in the vicinity of the heating roller within the fixing-unit.

Contact-type temperature sensors are widely used in image forming apparatus that requires high-speed processing and short warm-up time, from the viewpoint of securing durability and highly accurate temperature detection, compared to non-contact type temperature sensors. In this case, it is common that a temperature sensor having a heat sensitive element is arranged to contact the surface of a cylindrical heating roller along the radial direction of the heating roller to enable the temperature sensor to respond quickly.

Tokkai 2002-304084 (FIG. 4)

Tokkai 2001-5333 (FIG. 2)

However, contact condition between the surface of the heating roller and the temperature sensor worsens since residual toner, which adheres to the heating roller and paper powder of the recording medium adheres to the surface of the temperature sensor. It often happens that the detected temperature by the temperature sensor indicates a lower temperature than the actual temperature even though the temperature reaches the pre-determined temperature at which the toner can be fixed onto the recording medium.

Based on the above fact, there are cases in which toner copied onto a recording medium cannot be fixed on the recording medium due to the higher temperature of the heating roller than the temperature that is required and some of the toner adheres to the heating roller even when pressure is applied by the pressing roller, which is called, high temperature offset. Further, there are cases in which jamming problems occur due curled recording media.

To solve the above problems, there has been one proposal that cleaning unit, which automatically wipes contacting surfaces of the heat sensitive element of the temperature sensor. But there is a drawback that the equipment itself becomes more complex and costly. On the other hand, the adhesive force of the toner or powdered paper debris to the temperature sensor has been increasing and it has become more difficult to remove the adhesive toner with solvent during maintenance.

For example, heat resistant film 17, such as polyimides, is used to cover the contacting surface of the temperature sensor in order to protect the sensor portion. However, leaving the adhesive toner on the film at high temperature for a long time results in rigid portion on the film due to a chemical reaction between toner and the film. Also it has become more difficult to wipe the toner and paper powder off the temperature sensor since the toner clings to scratches caused by the heat resistant film 17 rubbing against the heating roller.

SUMMARY OF THE INVENTION

Objectives of this invention are to solve the problems mentioned above and provide following conditions by preventing toner, etc. from adhering to the temperature sensor and detecting the actual surface temperature of the heating roller. The first objective is to provide a fixing-unit to obtain high quality toner images by controlling fixing temperature based on precise temperature detection of the heating roller. The second objective is to achieve easier maintenance by improving durability of the temperature sensor.

In order to achieve these objectives, a fixing-unit of this invention should have at least a heating roller and a temperature detecting means for detecting the surface temperature of the heating roller.

The rotatable heating roller, which constitutes the fixing-unit, is in contact with a recording media on which non-fixed developing agent images have been copied. The roller heats up and melts the non-fixed developing agent images. Usually, a pressing roller, which is paired with the heating roller, is arranged so that it is in contact with the heating roller on the circumferential surface. This puts the recording medium, on which the non-fixed developing agent images have been copied, into a contact area under pressure and at the same time the heating roller heats up the recording medium to fix developing material images onto the recording medium under synchronized rotation with the heating roller.

A means for detecting temperature comprises a temperature-detecting element, which detects surface temperature of the heating roller, and a supporting member of the temperature-detecting element. This invention is characterized in that the temperature-detecting element is attached slightly upstream of a position where the supporting member contacts the circumference of the heating roller in the rotational direction.

It was found that residual toner and paper powder adhered to the heating roller accumulate downstream of a position where the supporting member, which constitutes the temperature-detecting means, is in contact with the circumference of the heating roller in the rotational direction, and within a triangle formed between the supporting member extended in a tangential direction and the circumference of the heating roller. To counter the above problem, according to the structure of the present invention, the structure makes it possible to detect precise temperature with less residual toner and paper powder over a long time by contacting the temperature-detecting element with the heating roller upstream on the contact area.

It is optimum to attach the temperature-detecting element at a position, which is upstream on the heating roller and away from the contacting position by 1.0 mm or less. Within this distance, it is possible to keep the temperature difference between the temperature of the heating roller and that of the temperature-detecting element within 5° C. or equal. For example, in the case that this distance is set at 1.5 mm, then the detecting error is about 16° C.

It is especially recommended that the temperature-detecting element, which constitutes part of the temperature-detecting means, comes into contact with the surface of the heating roller through a heat-resistant film. It is possible to insulate the heating roller from the temperature-detecting element by using this configuration. The heat-resistant film can protect the temperature-detecting element even though there is occasional splashing of non-fixed toner, since the non-fixed toner adheres to the heat-resistant film. This configuration also makes maintenance easier by merely changing and/or washing the heat-resistant film.

It is especially recommended that the contacting position of the temperature-detecting element with the surface of the heating roller is adjustable by shifting the supporting member of the temperature-detecting element. With such a configuration, it is not only easier to adjust the location of the temperature-detecting means but it is also possible to protect the temperature-detecting element from scratches caused by contact between the supporting member and the heating roller. Durability can be also improved by this configuration.

By using the fixing-unit based on this invention in an image forming apparatus, precise temperature detection of the heating roller can be achieved and high quality toner fixing images can be obtained over the long time.

BRIEF DESCRIPTION OF THE DRAWING

FIGS. 4(*a*) is a plan view and 4(*b*) is a cross-sectional view showing a configuration of a temperature detecting means and location of the heating roller of this invention.

DETAILED DESCRIPTION OF THE INVENTION

Figure 1:
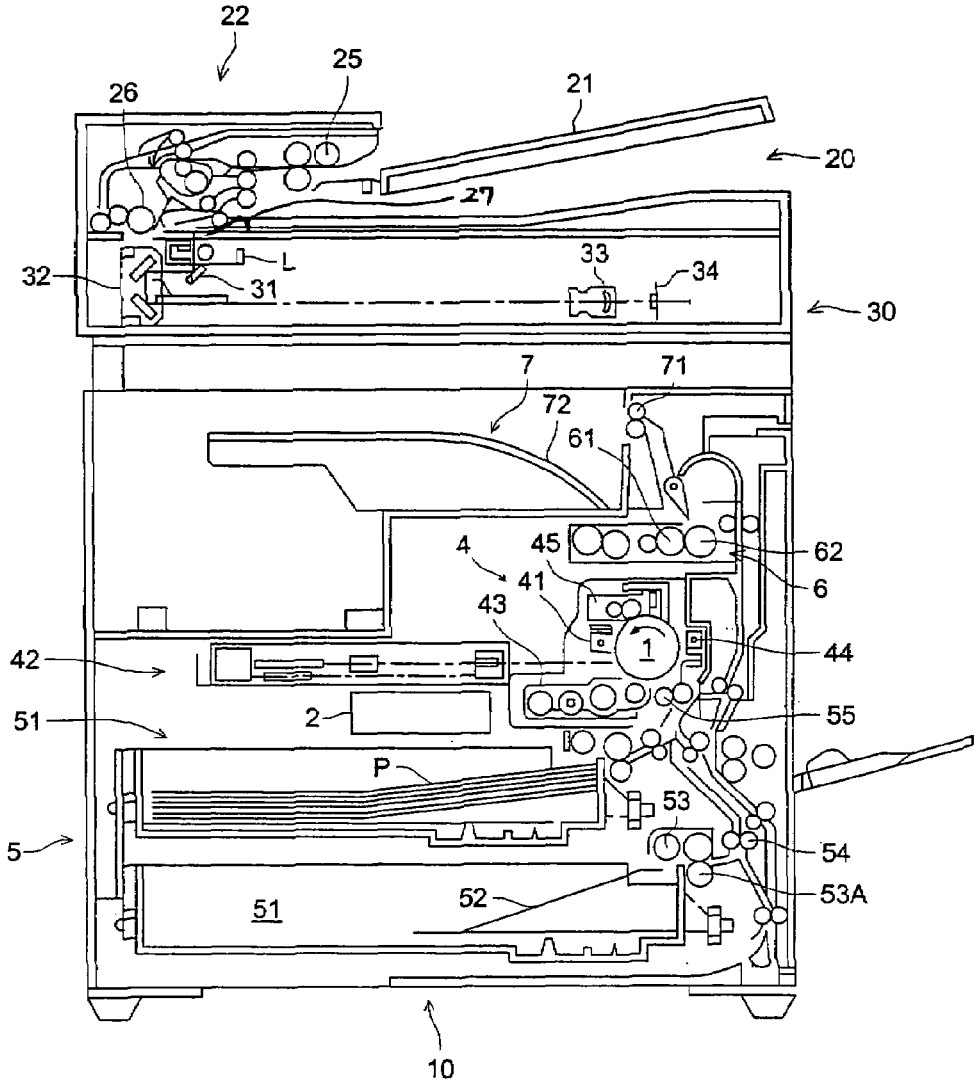
FIG. 1 is a schematic diagram of an image forming apparatus incorporating the fixing-unit of this invention.

Optimum embodiments of this invention will be explained by referring to drawings and figures. FIG. 1 is a schematic diagram of image forming apparatus 10 having a fixing-unit of this invention. However this invention is not limited to this embodiment.

Image forming apparatus 10 is an example of a digital copier having a re-conveying means for automatic double-sided copying. The main body of this equipment is equipped with image processing unit 2, an image-writing unit (exposing unit 42), cartridge-type paper supplying unit 5, paper ejecting unit 7 and the upper portion of this equipment is equipped with manuscript conveying unit 20 and image read-out unit 30.

Manuscripts (not shown) on manuscript support table 21 of manuscript conveying unit 20 is conveyed along a conveying path by ejecting unit pick-up roller 25 of automatic manuscript flipping over unit 22. Manuscript conveying unit resistant roller 26 attached at the very end of the conveying path passes the manuscripts over slit-glass 27 by synchronously rotating the manuscript page with scanning timing of image-reading unit 30.

Image-reading unit 30 is comprised of scanning unit 31, which is comprised of light source L, which radiates the manuscript page through slit-glass 27, dual elements of mirror 32, which guides reflected-beams, lens 33 and image sensor element 34 such as CCD, etc.

The manuscript pages are read by scanning unit 31 while passing over slit-glass 27 attached on the upper side of image reading unit 30 and those images are formed on image sensor element 34 through dual-elements of mirror 32 and lens 33. The read image information is processed in image-processing unit 2 and digitized image information is temporally stored in image-processing unit 2.

Image forming unit 4 incorporating photo-sensitive material 1 as a latent image material, is comprised of, in the order of processing, electrical charge generating device 41, which applies an almost uniform charge to the surface of photo-sensitive material 1, exposing unit 42, which transfers an electro-static image on the surface on the photosensitive material, developing unit 43, which transcribes toner onto the latent image formed on the surface of photo-sensitive material 1, copying unit 44, which copies the toner image on the surface of a photosensitive material and a cleaning unit 45, which cleans the residual toner from the surface of the photo-sensitive material 1.

Movable plate 52, whose free end is held upward by a spring means such as flat springs, is arranged to move the most upper paper sheet of the recording paper P on movable plate 52 to touch pick-up rollers 53. Recording paper sheets P, touching pick-up roller 53, is pulled from supplying paper cartridge 51 and conveyed to resistant roller 55 through plural middle rollers 54, after being individually separated by handling rollers 53A.

Recording paper P is conveyed to the copying unit 44 after being synchronized for paper-supplying timing by resistant roller 55 and the toner images formed on photo-sensitive material 1 are copied collectively on the recording paper sheets. The recording paper P on which the toner images are copied, is conveyed to the fixing-unit 6 of this invention. The toner images on recording paper P are processed by a fixing-unit 6. Ejecting rollers 71 which nip the recording paper and place them onto ejecting-paper table 72 feeds recording paper P, on which the toner images have been fixed, from the machine.

Figure 2:
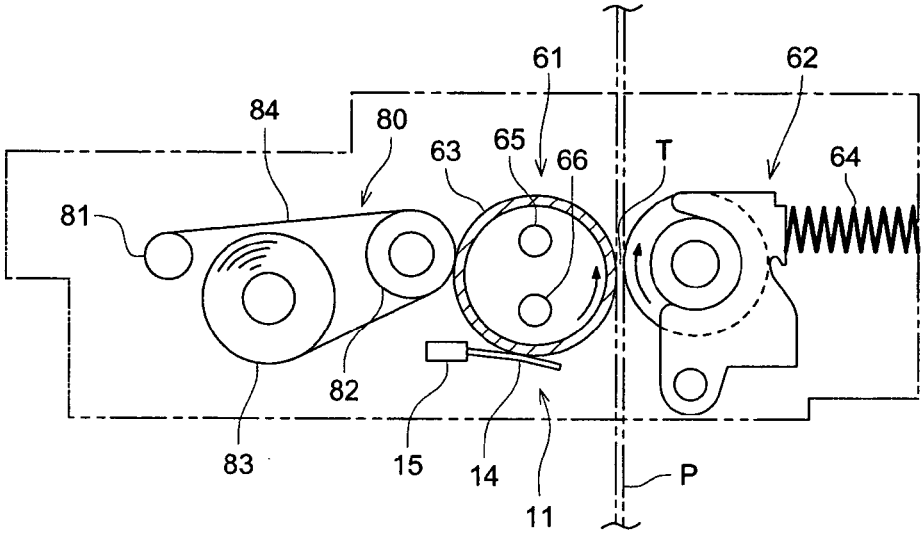
FIG. 2 is a schematic cross-sectional view showing an embodiment of the fixing-unit of this invention.

FIG. 2 is a schematic cross-sectional view of fixing-unit 6 of this invention. Fixing-unit 6 is comprised of heating roller 61, which heats the recording paper P in contact with one surface of the recording paper P, compression roller 62, which is arranged to be in contact with the heating roller 61 at some pressure, cleaning mechanism 80, which cleans residual toner from the surface of heating roller 61 and temperature detecting means 11 of this invention.

Heating roller 61 includes two halogen heat-lamps 65 and 66 mounted in its rotational axis direction and heated to the melting temperature of toner while being rotated in the direction shown by arrow in FIG. 2 by a driving motor (not shown).

Figure 3:
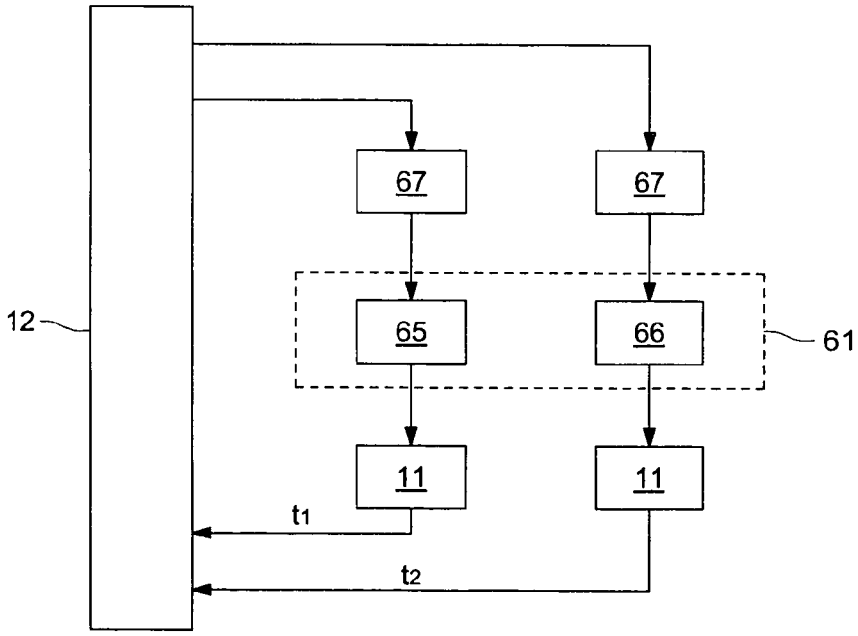
FIG. 3 is a block diagram showing an embodiment of the driving control for the fixing-unit of this invention.

FIG. 3 is a block diagram showing the driving control of fixing-unit 6. First heat lamp 65 heats up the central portion of heating roller 61 and second heat lamp 66 heats up both end-portions of heating roller 61. Heat lamps 65 and 66 are driven by control unit 12 based on the width of recording paper P to be fixed.

Heating roller 61 is heated and the toner image held on the recording paper P is melted while in contact with the outer circumference of heating roller 61. In order to improve copy-quality, resin-treated layer 63, exhibiting high heat resistance, is formed on the outer circumference of a cylindrical core metal as a mould-releasing layer.

The rotating shaft of compression roller 62 is supported to rotate in time with rotation of heating roller 61. This compression roller 62 adheres the toner images onto the recording paper in contact with heating roller 61 pressed by a spring means such as spring 64, at least when fixing. In order to form nipping-portion T easily between heating roller 61 and compression roller 62, an elastic layer is provided on surface of compression roller 62.

Constant-adhesive cleaning mechanism 80, which cleans the surface of heating roller 61, is provided downstream in the rotational direction of nipping portion T, contacting the outer circumference of heating roller 61. In this constant-adhesive cleaning mechanism 80, heat-resistant non-woven fabric, with a mould-releasing agent soaked, of cleaning web 84 is spread over winding-up roller 81, back-up roller 82 and source-winding roller 83. Cleaning mechanism 80 functions, to remove the residual toner and paper-powdered debris, which are adhered on the surface of heating roller 61, by pressing/contacting the cleaning web 84 onto resin-treated layer 63 of heating roller 61 aided by back-up roller 82.

In order to maintain cleaning-ability of cleaning mechanism 80 is so arranged that fresh portion of cleaning web 84 advance little by little so that a clean web surface is always in contact with resin-treated layer 60 of the heating roller 61 as winding-up roller 81 winds up the dirty web.

Temperature detecting means 11, which detect the temperature of heating roller 61 and sends out its detected signal to control unit 12, is provided at the central portion and edge portions of the heating roller 61, which are located down steam of the rotational direction of heating roller 61 in constant-adhesive cleaning mechanism 80. Control unit 12 (see FIG. 3) drives heater driving circuit 67 and powers heat-lamps 65 and 66, which are provided in heating roller 61 so that the temperature of outer circumference of heating roller 61 is held at the toner-melting temperature. Heat-lamps 65 and 66 are driven based on the width of recording paper P.

Temperature detecting means 11 will now be explained. FIG. 4*a* is a schematic diagram showing the configuration of temperature detecting means 11 and heating roller 61. This temperature detecting means 11 includes thermistor element 13 as a heat-sensitive element and flat springs 14. Resin-mould unit 15 fixes one end of flat springs 14. Projection 150 is formed at resin-mould unit 15 to limit the setting direction, and the location of the resin-mould unit 15 is set correctly by screwing it onto sensor attaching panel 16.

Flat springs 14 are made of thin metal plates having elasticity and are in contact with the outer circumference of heating roller 61 at other free end with the holding force of flat springs 14 as shown in FIG. 4(*b*). Thermistor element 13 is supported between two leaves of flat springs 14, which are used as lead lines connected to exterior terminals (not shown). (See FIG. 4(*a*))

Figure 5:
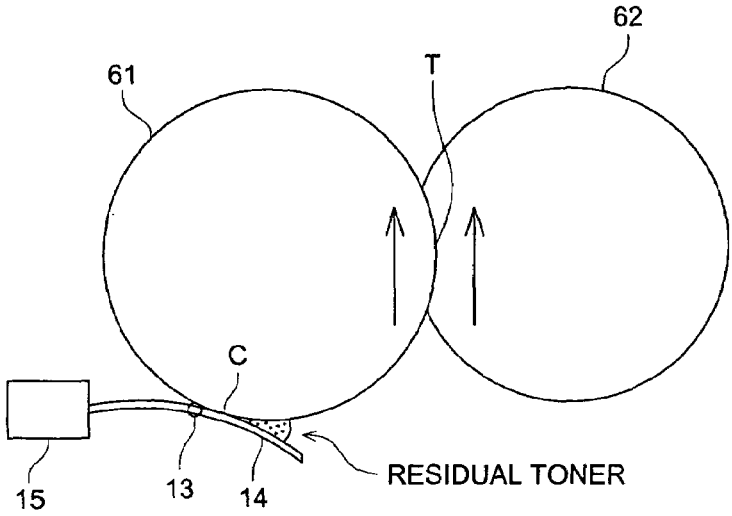
FIG. 5 is a schematic cross-sectional view of the configuration of the temperature detecting means of this invention.

FIG. 5 is a magnified schematic cross sectional view of temperature detecting means 11. As shown in FIG. 5, thermistor element 13 is arranged to contact the surface of heating roller 61 upstream of tangential line position C where a tangential line contacts the outer circumference of heating roller 61.

It is known that toner, which cannot be removed by constant-adhesive mechanism 80, remains on the surface of heating roller 61, and is accumulated by rubbing flat springs 14 onto heating roller 61, at a wedge portion formed by the outer circumference of heating roller 61 and flat springs 14, which is extended in the tangential direction, as time passes and reaches the end of the durable term of the device.

It is recommended to attach themister element 13 at a position where the flat springs 14 contact the outer circumference of heating roller 61 in the tangential direction, from the view point of optimal response of temperature detection. Themister element 13 is set upstream with some allowable deviation in this invention due to the probability that precise temperature detection cannot be made due to the toner and/or paper powder adhesion to the surface of heating roller 61.

Figure 6:
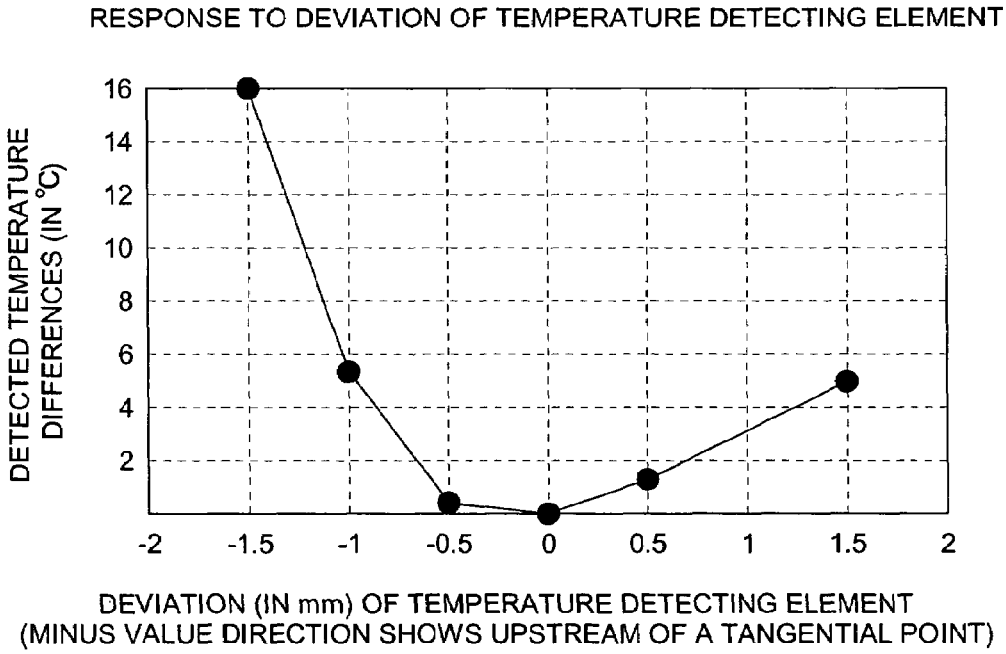
FIG. 6 is a graph showing the relationship between the location of the thermistor element and the response of temperature detection.

FIG. 6 is a graph showing a relationship between attached-location of themister element 13 against contacting position C of a tangential line and response of temperature detection. As shown in the FIG. 6, the deviation toward upstream side in the rotational direction should be 1.0 mm or less. Deviation more than 1.0 mm may not achieve a precise temperature control since temperature difference between thermistor element 13 and detected temperature becomes about 15.9 degree Celsius due to the fact that adequate contact-presser between thermistor element 13 and heating roller 61 cannot be obtained securely.

As shown in FIG. 4(*a*), resin-mould section 15 incorporating temperature detecting means 11 can be attached to and detached from sensor setting plate 16, for easier maintenance by making it possible to make fine adjustments of contacting position of thremister element 13, flat springs 14 and heating roller 61.

It is especially recommended in this invention that a heat-resistant film should cover thermistor element 13 to prevent direct contact with heating roller 61, in other words, insulation tape should be placed on flat springs 14 which would then contact heating roller 61 via a heat-resistant film. It is possible to prevent resin-treated layer 63 on heating roller 61 from being scratched caused by rubbing between flat springs 14 and heating roller 61. Also, it thereby then becomes possible to improve maintenance capability since it is possible to prevent thermistor element from being adhered by residual toner and/or paper powder since thermistor element can be easily insulated from heating roller 61.

Operations of image forming apparatus 10 and fixing-unit 6 of this invention will now be explained. Images are read by scanning unit 31 while passing over slit glass 27 provided above image reading unit 30 after which the images are re-formed on image sensor element 34 through dual-element mirror 32 which guides reflected beams, and lens 33.

Digitized image information data is stored temporarily in image-memory after the textual image information read out by image senor element 34 is processed such as A/D conversion, shading compensation and image compression, etc. in image processing unit 2.

Exposing unit 42, which constitutes an image-writing unit, modulates a semiconductor laser electrically based on this image data and performs vertical scanning by a polyhedron mirror and a lens block through a collimator lens. Furthermore, electro static latent images are formed on photosensitive material 1 by horizontal scanning, which can be done during a single rotation of the drum carrying photosensitive material 1.

Prior to exposure, a certain surface-electro charge has been applied over photosensitive material 1 by corona discharge of electro-charging equipment 41 in image forming unit 4. Electrons on exposed portions are decreased based on the amount of radiated laser beam and as a result, an electro-static latent image is formed on photosensitive material 1.

An electro static latent image is converted to a visualized toner image by toner as a developing process supplied by developing unit 43. A visible toner image formed on photosensitive material 1 is copied onto recording paper P by copy equipment 44.

Recording paper P stored in paper supply cartridge 51 which constitutes cartridge paper supply 55, is supplied by pickup roller 53, and conveyed by plural intermediate rollers 54 after overlapping-conveyance is checked by handling roller 53A. Recording paper P, guided by plural intermediate rollers 54 is arranged to strike its edge to resistant roller 55, which will not yet have started rotating, and forms loop of recording paper P. Consequently, angle-conveyance of misaligned recording paper P is corrected.

Resistant roller 55 starts rotation and conveys recording paper sheets P to copy equipment 44, after the location of toner image formed on photosensitive material 1 has been synchronized with the location of the leading edge of recording paper sheets P. As a result, recording paper sheets P are superposed on the toner image in copy equipment 44 and the toner image is copied onto the recording paper sheets P collectively as copy-bias voltage is applied at the same time.

Recording paper P is conveyed to fixing-unit 6 after being separated from photosensitive material 1, and particle of toner, which constitute the image, are melted and fixed on recording paper sheets P by the heating effect of heating roller 61, which constitutes part of fixing-unit 6.

The following is a detailed explanation for operation of fixing-unit 6. Recording paper sheets P on which non-fixed toner image is loosely adhered, is placed into nip T formed between heating roller 61 and compression roller 62. The toner image particles melted by heat roller 61, are absorbed into recording paper sheets P and fixed by pressure from the rear of recording paper sheets P by compression roller 62 being pressed by spring 64.

Particle of residual toner and paper dust start adhering on the surface of heating roller 61 since the outer circumference of heating roller 61 is in contact with toner and recording paper sheets P during usage of the equipment. Normally, the toner and/or paper dust are wiped away by cleaning web incorporated in continual adhesive-cleaning mechanism 80, which is attached downstream in the rotational direction of heating roller 61.

Temperature detecting means 11 set downstream of continual adhesive-cleaning mechanism 80, detects the surface temperature of heating roller 61 and feeds-back to control unit 12. Control unit 12 regulates heater-driving circuit 67 for powering and controlling heat-lamps 65 and 66 to maintain the surface temperature of heating roller 61 at the optimal toner melting temperature.

However, as usage of the equipment continues, adequate cleaning effects cannot be maintained by constant adhesive cleaning mechanism 80. As a result, when direct contact type temperature detecting means 11 is used, it becomes difficult to obtain precise surface temperature reading of heating roller 61 since residual toner and paper dust adhere to the surface of thermistor element 13, whereby consequently, contact condition between thermistor element 13 and heating roller 61 becomes worse. Also, it becomes difficult to remove the toner and paper dust with solvent, etc, which are adhered to heat-resistant film, which protects the surface of thermistor element 13, by solvent, etc.

In order to overcome the drawbacks detailed above, installation location of thermistor element 13 in the temperature detection means has been changed in this invention. It is empirically known that when contact type temperature detecting means 11 is used, residual toner adhered to the surface of heating roller 61 as shown in FIG. 5, accumulates in the space formed between flat springs 14 and heating roller 61, across the surface of heating roller 61, and located downstream of the position where a tangential line of flat springs 14 contacts heating roller 61.

Then, thermistor element 13, supported by flat springs 14, is located upstream of tangential line position C where tangential line of flat springs 14 contacts heating roller 61. As a result, it becomes possible to prevent the detected temperature from dropping down due to residual toner, since the temperature is detected upstream where residual toner does not adhere even through continuous usage of the equipment.

As described above, it is possible to assure precise temperature detection by using a fixing-unit of this invention even though toner and/or paper dust residue is on the surface of the heating roller after prolonged operation, since the supporting member of the temperature detection means is pushing the residual toner downstream of the heating roller, and thermal detection is done upstream in the rotational direction of the heating roller where residual toner does not accumulate on the supporting member of temperature detection means.

Temperature detection thus becomes more accurate since the volume of residual toner, which adheres to the temperature-detecting element, can be decreased without lowering sensitivity of the temperature-detecting element. Consequently, temperature of the heating roller can be controlled at a temperature lower than the fixing temperature and image quality degradation caused by high-temperature offset can be solved.

Furthermore, a mould-release layer formed on the outer circumference of a heating roller cannot be damaged since the temperature-detecting element is in contact with heating roller via a heat-resistant film and cleaning of the heat-resistant film can be done in a very short time. It is not always necessary to change the heat-resistant film in some cases, which resulting in improved maintenance.

What is claimed is:

1. A fixing device, comprising:

a heating roller which applies heat onto a non-fixed toner image formed on a recording medium so as to fuse said non-fixed toner image, wherein said heating roller is rotatably supported on a shaft so that a circumferential surface of said heating roller contacts said recording medium, which bears said non-fixed toner image, while rotating; and a temperature detecting unit that includes a temperature detecting element in order to detect a surface temperature of said circumferential surface of said heating roller, and a flat spring support member on which said temperature detecting element is mounted at a temperature detecting position;

wherein said temperature detecting unit is disposed in such a manner that said flat spring support member press-contacts said circumferential surface of said heating roller at a contacting position residing on said flat spring support member in a rotating direction of said heating roller; and wherein said temperature detecting position of the temperature detecting unit is located upstream from said contacting position of said flat spring support member in said rotating direction of said heating roller.

2. The fixing device of claim 1, wherein said flat spring support member comprises an elastic material and said flat spring support member press contacts said circumferential surface by means of elastic deformation of said flat spring support member.

3. The fixing device of claim 1, wherein a distance between said detecting position and said contacting position is at most equal to 1.0 mm in said rotating direction of said heating roller.

4. The fixing device of claim 1, wherein a heat-resistant film is disposed between said temperature detecting element and said circumferential surface of said heating roller.

5. The fixing device of claim 1, wherein a distance between said temperature detecting position and said contacting position on said flat spring support member is adjustable.

6. The fixing device of claim 1, wherein said flat spring support member has a plate-shape, and an end portion of said flat spring support member is fixed rigidly, while another end portion of said flat spring support member press contacts said circumferential surface of said heating roller at said contacting position of said flat spring support member in said rotating direction of said heating roller.

7. The fixing device of claim 6, wherein said flat spring support member includes two plate members, and said temperature detecting element is supported between said two plate members.

8. The fixing device of claim 7, wherein said two plate members are covered with a heat-resistant film so that said flat spring support member press-contacts said circumferential surface through said heat-resistant film.

9. An image forming apparatus, comprising an image forming section which forms a non-fixed toner image on a recording medium; and a fixing device which fixes said non-fixed toner image, formed by said image forming section, onto said recording medium wherein said fixing device, comprises:

a heating roller which applies heat onto said non-fixed toner image formed on said recording medium so as to fuse said non-fixed toner image, wherein said heating roller is rotatably supported on a shaft so that a circumferential surface of said heating roller contacts said recording medium, which bears said non-fixed toner image, while rotating; and a temperature detecting unit that includes a temperature detecting element in order to detect a surface temperature of said circumferential surface of said heating roller, and a flat spring support member on which said temperature detecting element is mounted at a temperature detecting position;

wherein said temperature detecting unit is disposed in such a manner that said flat spring support member press-contacts said circumferential surface of said heating roller at a contacting position residing on said flat spring support member in a rotating direction of said heating roller; and wherein said temperature detecting position of said temperature detecting unit is located upstream from said contacting position of said flat spring support member in said rotating direction of said heating roller.

* * * * *